US006574891B1

(12) United States Patent
Ireland et al.

(10) Patent No.: US 6,574,891 B1
(45) **Date of Patent: *Jun. 10, 2003**

(54) EXCAVATION BUCKET INCORPORATING AN IMPACT ACTUATOR ASSEMBLY

(75) Inventors: Odin Ireland, Montréal (CA); Claude Cote, Varennes (CA)

(73) Assignee: 3786111 Canada Inc., Ste-Julie (CA)

( * ) Notice: Subject to any disclaimer, the term of this patent is extended or adjusted under 35 U.S.C. 154(b) by 0 days.

This patent is subject to a terminal disclaimer.

(21) Appl. No.: 09/623,749

(22) PCT Filed: Mar. 10, 1998

(86) PCT No.: PCT/CA98/00205

§ 371 (c)(1),
(2), (4) Date: Sep. 8, 2000

(87) PCT Pub. No.: WO99/46451

PCT Pub. Date: Sep. 16, 1999

(51) Int. Cl.[7] ..... E02F 3/36
(52) U.S. Cl. ..... 37/447; 37/403
(58) Field of Search ..... 37/446, 403, 447, 37/444, 466, 906, 904

(56) References Cited

U.S. PATENT DOCUMENTS

| | | | | | |
|---|---|---|---|---|---|
| 2,228,448 | A | | 1/1941 | de Velbiss | |
| 3,113,390 | A | * | 12/1963 | Pewthers | 37/447 |
| 3,512,284 | A | * | 5/1970 | Haynes | 37/447 |
| 3,520,076 | A | * | 7/1970 | Nichols | 172/701.3 |
| 3,645,021 | A | * | 2/1972 | Sonerud | 173/203 |
| 3,659,730 | A | * | 5/1972 | Butler | 37/444 |
| 4,111,269 | A | * | 9/1978 | Ottestad | 173/170 |
| 4,132,017 | A | * | 1/1979 | Robson et al. | 37/447 |
| 4,625,438 | A | * | 12/1986 | Mozer | 37/414 |
| 4,892,359 | A | * | 1/1990 | Ottestad | 37/447 |
| 4,959,915 | A | * | 10/1990 | Roussin et al. | 172/40 |
| 5,065,326 | A | * | 11/1991 | Sahm | 340/686.1 |
| 5,065,824 | A | * | 11/1991 | Ottestad | 173/206 |
| 5,269,382 | A | * | 12/1993 | Ottestad | 173/128 |
| 5,353,532 | A | * | 10/1994 | Lysenko et al. | 172/101 |
| 5,408,768 | A | * | 4/1995 | Karani | 172/664 |
| 5,678,332 | A | * | 10/1997 | Hawkins | 37/403 |
| 5,727,639 | A | * | 3/1998 | Jeter | 173/126 |
| 6,032,093 | A | * | 2/2000 | Denbraber et al. | 37/348 |

FOREIGN PATENT DOCUMENTS

| | | |
|---|---|---|
| FR | 2 277 943 | 2/1976 |
| GB | 2 220 962 | 1/1990 |
| WO | WO 90/10756 | 9/1990 |
| WO | WO 93/23210 | 11/1993 |

* cited by examiner

*Primary Examiner*—Thomas B. Will
*Assistant Examiner*—Kristine Florio
(74) *Attorney, Agent, or Firm*—Eric Fincham

(57) ABSTRACT

An excavation bucket incorporating an impact actuator assembly is described herein. The excavation bucket includes a bucket body, a movable head, a movable floor portion mounted to the movable head and an impact actuator provided between and mounted to the bucket body and the movable head. The movable head is longitudinally movable in the bucket body. The movable head is provided with tools, such as teeth, to penetrate hard soils. These tools are slidably mounted in the movable head to reach a retracted position when they are pushed against hard soil. When the impact actuator is activated, the longitudinal impacts generated by the impact actuator drive the tools into the hard soil if the tools are in their retracted positions. However, if the impact actuator is activated while the tools are not in their retracted position, the longitudinal impacts will cause the repetitive longitudinal movements of the movable head and thus of the movable floor with respect to the bucket body.

38 Claims, 18 Drawing Sheets

EXCAVATION BUCKET INCORPORATING AN IMPACT ACTUATOR ASSEMBLY

FIELD OF THE INVENTION

The present invention relates to excavation buckets. More particularly, the present invention is concerned with excavation buckets incorporating an impact actuator assembly.

BACKGROUND OF THE INVENTION

The prior art is replete with configurations of excavating buckets designed to better dig into hard soils.

For example, U.S. Pat. No. 4,625,438 entitled: "Excavating bucket having power driven, individually controlled digging teeth" issued on Dec. 2, 1986 to Daniel S. Mozer describes an excavating bucket having a leading edge provided with a row of individually pneumatically driven digging teeth. Each digging tooth is connected to a pneumatic impact hammer that reciprocates the tooth at high speed and with great force.

The excavating bucket described by Mozer has several drawbacks. For example, since pneumatic impact hammers are used, the earth working machine to which the excavating bucket is mounted must be provided with an air compressor and adequate supplemental conduits between the air compressor and the bucket. Also, since each tooth is connected to an individual pneumatic impact hammer, the total weight of the excavating bucket is much higher than the weight of a conventional bucket, which is a disadvantage when the arm of the earthmoving machine is fully extended, since conventional earth moving machines are generally designed to move weights similar to the weight of conventional buckets. Yet another drawback of the excavating bucket of Mozer is that since impact hammers generally require an external force compressing the internal piston, the teeth will be displaced by the hammers only when they supply this compression force by contacting a hard soil.

Patent Cooperation Treaty application published under number WO 93/23210 on Nov. 25, 1993, entitled "IMPACT DEVICE" and naming Jack Benton Ottestad as inventor describes a custom impact device mounted to an excavating bucket. While the device described by Ottestad is an improvement over the device of Mozer, it still has the above mentioned drawback that the blade is only actuated by the impact device when the blade is in a position to compress the internal piston of the impact device.

OBJECTS OF THE INVENTION

An object of the present invention is therefore to provide an improved excavating bucket incorporating an impact actuator.

Another object of the invention is to provide an excavating bucket incorporating an impact actuator free of the above mentioned drawbacks of the prior art.

SUMMARY OF THE INVENTION

More specifically, in accordance with the present invention, there is provided an excavation bucket comprising:

- a bucket body including a base portion and lateral side portions; the base portion having a longitudinal axis;
- a movable floor so mounted to the bucket body as to (a) be longitudinally slidable between a retracted position and an extended position, and (b) provide a free space between the base portion and the movable floor; and

- means for selectively slide the movable floor between the retracted and extended positions; the sliding means being mounted in the free space.

According to another aspect of the present invention there is provided an excavation bucket comprising:

- a bucket body including a base portion and lateral side portions; the base portion having a longitudinal axis;
- a movable head so mounted to the bucket body as to be longitudinally slidable between a retracted position and an extended position; the movable head including a movable head body provided with a proximate end and a distal end and at least one tool receiving aperture extending from the proximate end to the distal end;
- a movable floor so mounted to the movable head body as to provide a free space between the base portion and the movable floor;
- an impact actuator including an impact actuator body mounted to the bucket body and impact head so mounted to the actuator body as to be selectively movable between a retracted position and an extended position; the impact actuator being mounted in the free space; and
- at least one tool configured and sized to be slidably inserted in the tool receiving aperture of the movable head body; when inserted in the tool receiving aperture, the tool being slidable between an extended position and a retracted position where the tool contacts the impact head; wherein the impact head, when in its extended position, (a) contacts the proximate end of the movable head body when the tool is in its extended position and (b) contacts the tool when the tool is in its retracted position.

Other objects, advantages and features of the present invention will become more apparent upon reading of the following non restrictive description of preferred embodiments thereof, given by way of example only with reference to the accompanying drawings.

DESCRIPTION OF THE PREFERRED EMBODIMENT

Figure 1:
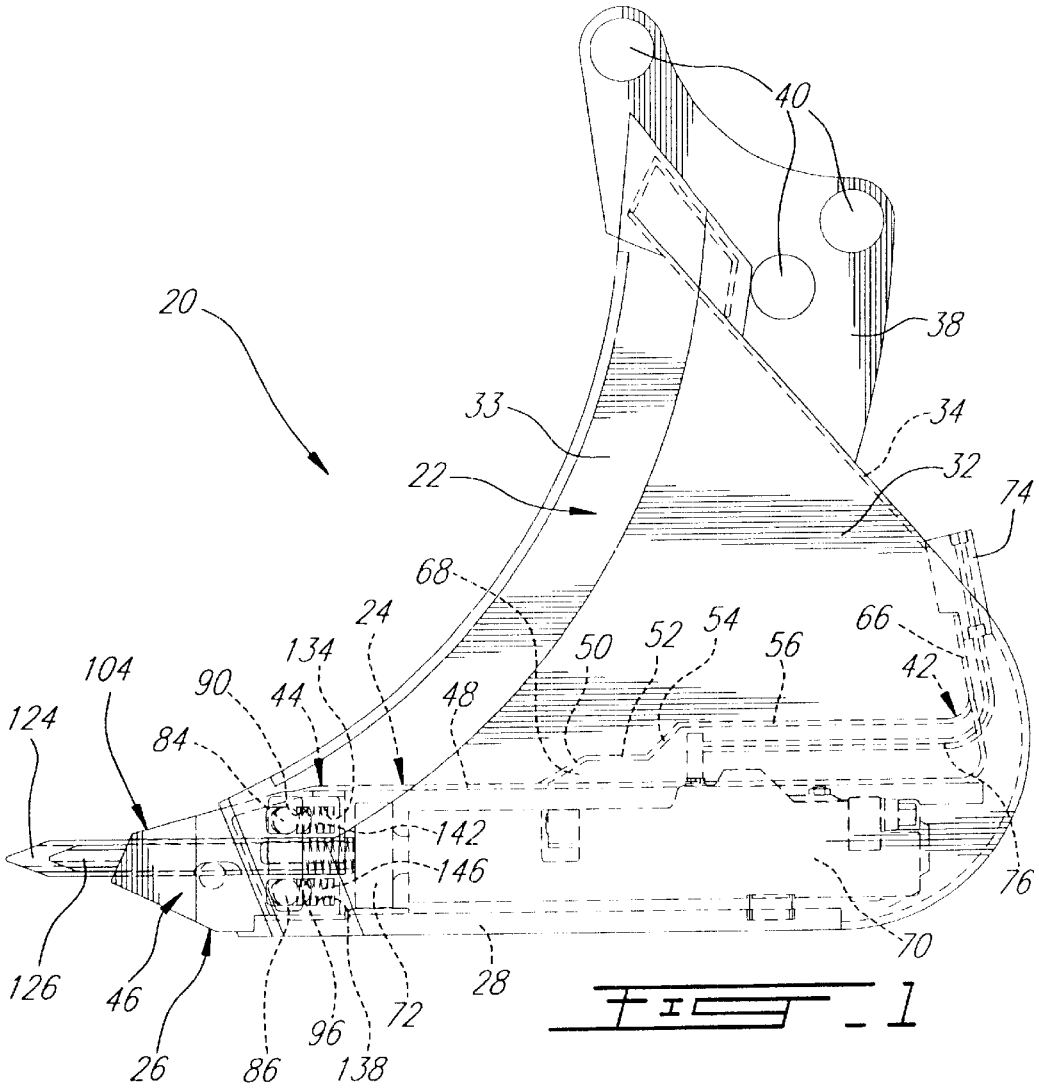
FIG. 1 is a side elevational view illustrating an excavating bucket according to an embodiment of the present invention.
Figure 2:
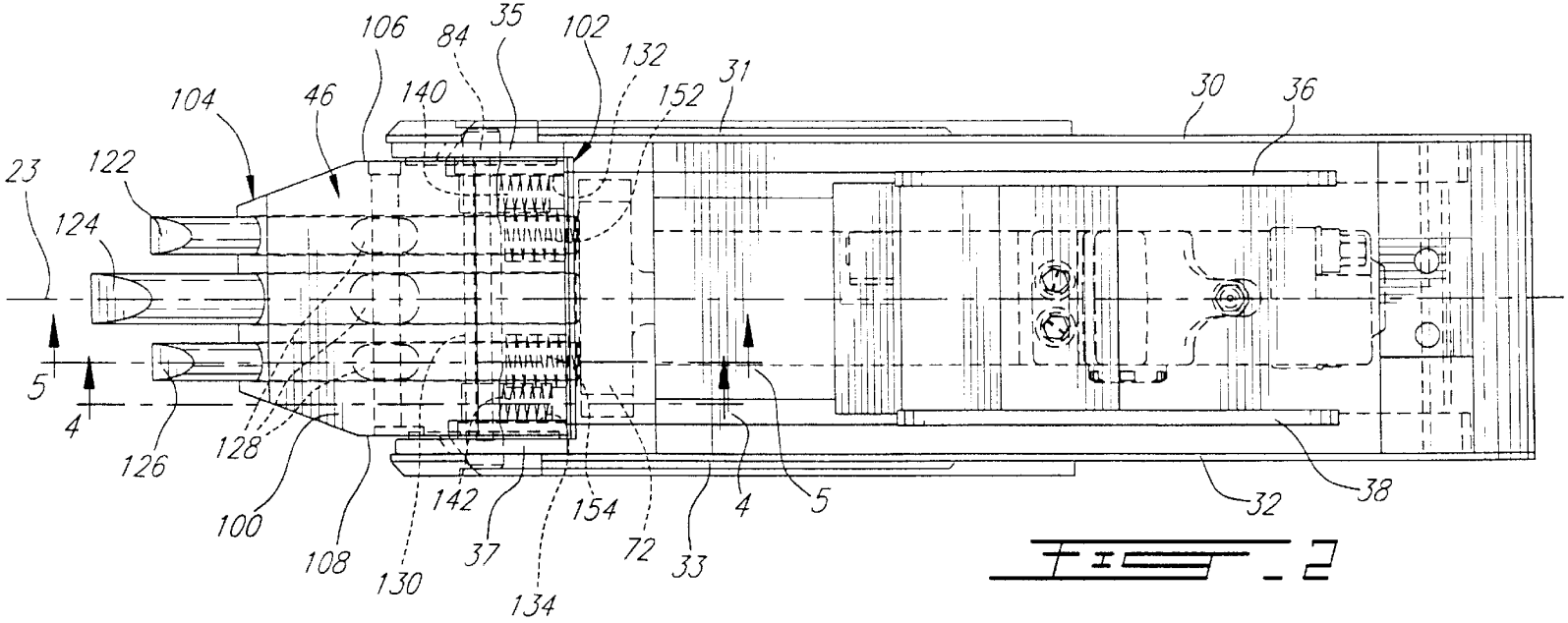
FIG. 2 is an enlarged top plan view of the excavating bucket of FIG. 1.
Figure 3:
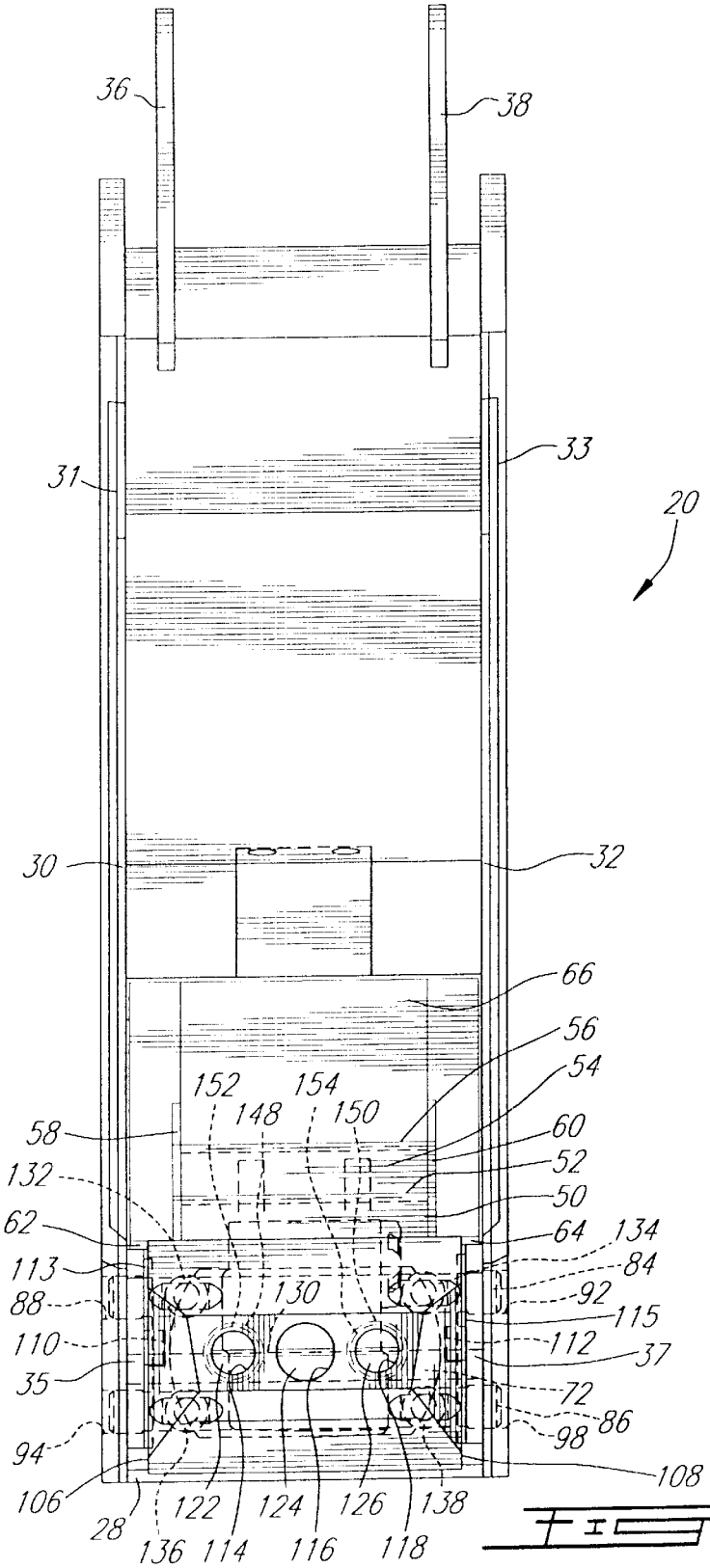
FIG. 3 is an enlarged front elevational view of the excavating bucket of FIG. 1.

Referring to FIGS. 1 to 3 of the appended drawings, an excavation bucket 20 according to a preferred embodiment of the present invention will be described. The excavation bucket 20 generally includes a bucket body 22, a longitudinally movable floor 24 and an impact actuator assembly 26.

The bucket body 22 has a longitudinal axis 23 ( FIG. 2) and includes a base 28, a pair of lateral side walls 30, 32, a rear wall 34, and a pair of mounting elements 36, 38 each provided with apertures 40 to which the end of the arm of a conventional earth moving machine (not shown) may be secured.

The lateral walls 30 and 32 are respectively provided with forward extension elements 31, 33 made of a material, for example HARDOX 400™, that may be sharpened to a cutting edge. Two guiding elements 35, 37 (see FIG. 2) provided with respective projections (see numeral 39 in FIG. 4) are respectively and fixedly mounted to the internal surfaces of the walls 30, 32. The purpose of the guiding elements 35, 37 will be described hereinafter.

The movable floor 24 includes a proximate end 42 and a distal end 44. The distal end 44 is mounted to a movable head 46 of the impact actuator assembly 26. The movable floor 24 generally consists of a first flat portion 48, a first angled portion 50, a second flat portion 52, a second angled portion 54, third flat portion 56, first and second vertical portions 58 and 60 (FIG. 3), first and second lateral flat portions 62, 64 (FIG. 3) and a rear curved portion 66. As will be described hereinbelow, the movable floor 24 is so mounted to the movable assembly 46 as to be reciprocately longitudinally slidable between a retracted position (illustrated in FIG. 1) and an extended position (shown in FIG. 14).

The configuration and position of the movable floor 24 with respect to the bucket body 22 create a free space 68 (FIG. 1) between the generally inverted U-shaped portion of the movable floor 24 and the base 28 of the bucket body 22.

It is to be noted that the configuration of the movable floor 24 is at least partially dictated by the required shape of the free space 68 as will be described hereinbelow.

The impact actuator assembly 26 includes an impact actuator 70, an impact head 72 and a movable head 46.

The impact actuator 70 is fixedly mounted to the bucket 22 in the free space 68 between the movable floor 24 and the base 28. To hydraulically connect the impact actuator 70 to the earth moving machine (not shown) the impact actuator 70 also includes a manifold 74 to which the hydraulic fluid conduits (not shown) of the earth moving machine may removably be connected. Hydraulic fluid conduits 76 are fixedly connected between the manifold 74 and the impact actuator 70. Grease conduits (not shown) are also provided between the manifold 74 and the impact actuator 70 to allow maintenance of the impact actuator 70 without requiring the removal of the movable floor 24.

It is to be noted that since the impact actuator 70 is similar to conventional impact actuators that are conventionally mounted to the booms of earth moving machines, conventional fluid conduits of the earth moving machine may advantageously be connected to the manifold 74 for the selective operation of the impact actuator. Accordingly, the impact actuator assembly 70 is advantageously an hydraulic impact actuator. However, a pneumatic impact actuator (not shown) could also be used, provided that adequate air supply is present on the earth moving machine. Of course, other modifications would possibly be required to allow a pneumatic impact actuator to be used.

The different elements and the general operation of a hydraulic impact actuator, such as impact actuator 70, are believed well known in the art. Accordingly, for concision purposes, only elements relevant to the description or to the operation of the excavation bucket incorporating an impact actuator assembly of the present invention will be described hereinbelow. It will therefore be understood that omissions or generalizations in the description or in the operation of the impact actuator 70 should not be construed in any way as limiting the present invention.

Figure 6:
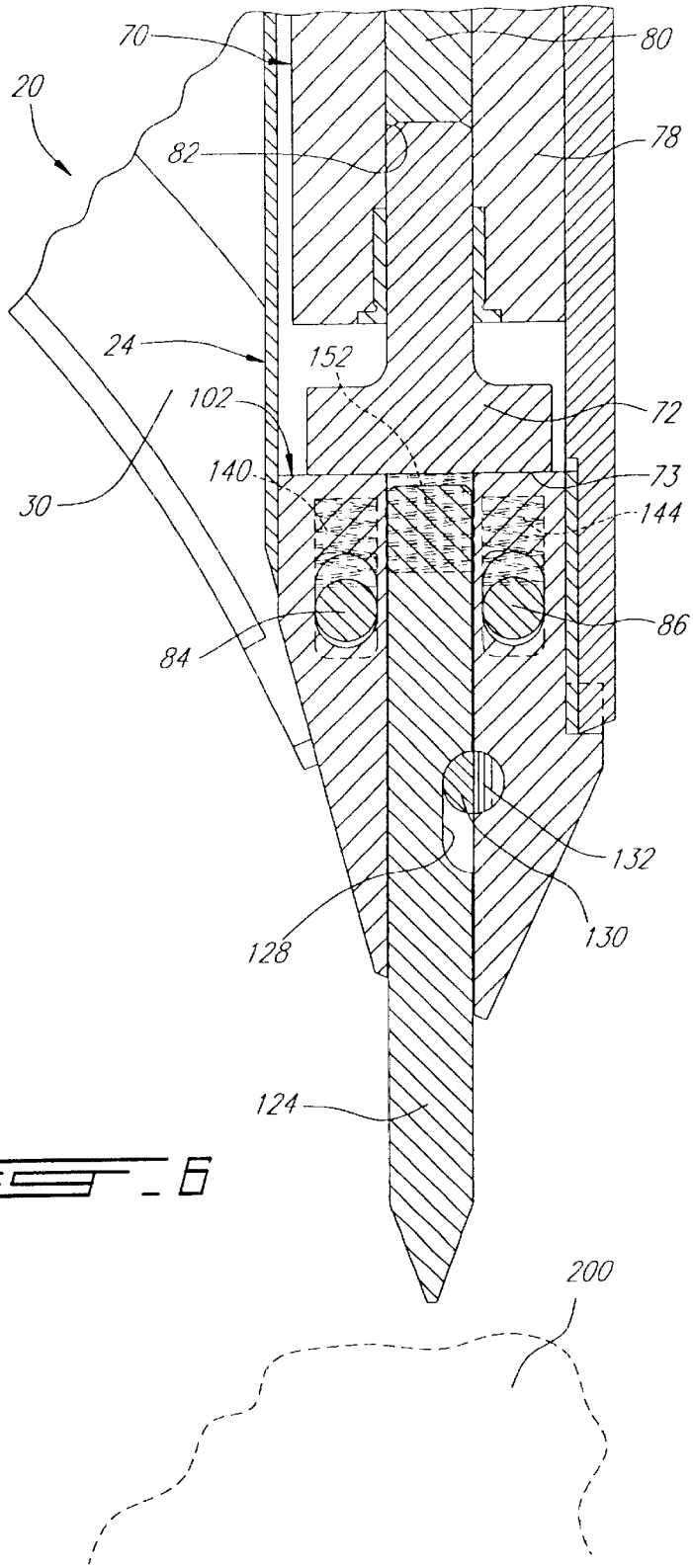
FIG. 6 is a side sectional view illustrating the front portion of the excavating bucket of FIG. 1 before a contact with a rock.

Referring briefly to FIG. 6 of the appended drawings showing a sectional view of the impact actuator 70, the impact actuator 70 includes a generally tubular body 78 and a reciprocating hammer 80 slidably mounted in an axial aperture 82 of the body 78 for longitudinal movements between first and second positions.

The impact head 72 has a generally T-shape crosssection and includes an impact surface 73, as can be better seen in FIG. 6. The configuration and size of the impact head 72 allow the impact head 72 to be slidably mounted in the axial aperture 82 of the body 78.

Returning to FIGS. 1 to 3, the movable head 46 is mounted to the lateral walls 30, 32 of the bucket body 22 for reciprocal sliding movements between retracted and extended positions via a pair of cylindrical mounting pins 84, 86. More specifically, the cylindrical pin 84 extends through a circular aperture 88 of the wall 30, a transversal oblong aperture 90 (see FIG. 4) of the movable head 46 and a circular aperture 92 of the wall 32. Similarly, the cylindrical pin 86 extends through a circular aperture 94 of the wall 30, a transversal oblong aperture 96 (see FIG. 4) of the movable head 46 and a circular aperture 98 of the wall 32.

It is to be noted that the movable head 46 and the attached movable floor 24 may easily be removed from the bucket body 22 by removing the mounting pins 84, 86 and by longitudinally sliding the movable head 46 from the bucket 22.

The movable head 46 includes a solid body 100 having a proximate portion 102, a distal portion 104 and opposite lateral walls 106, 108.

Figure 4:
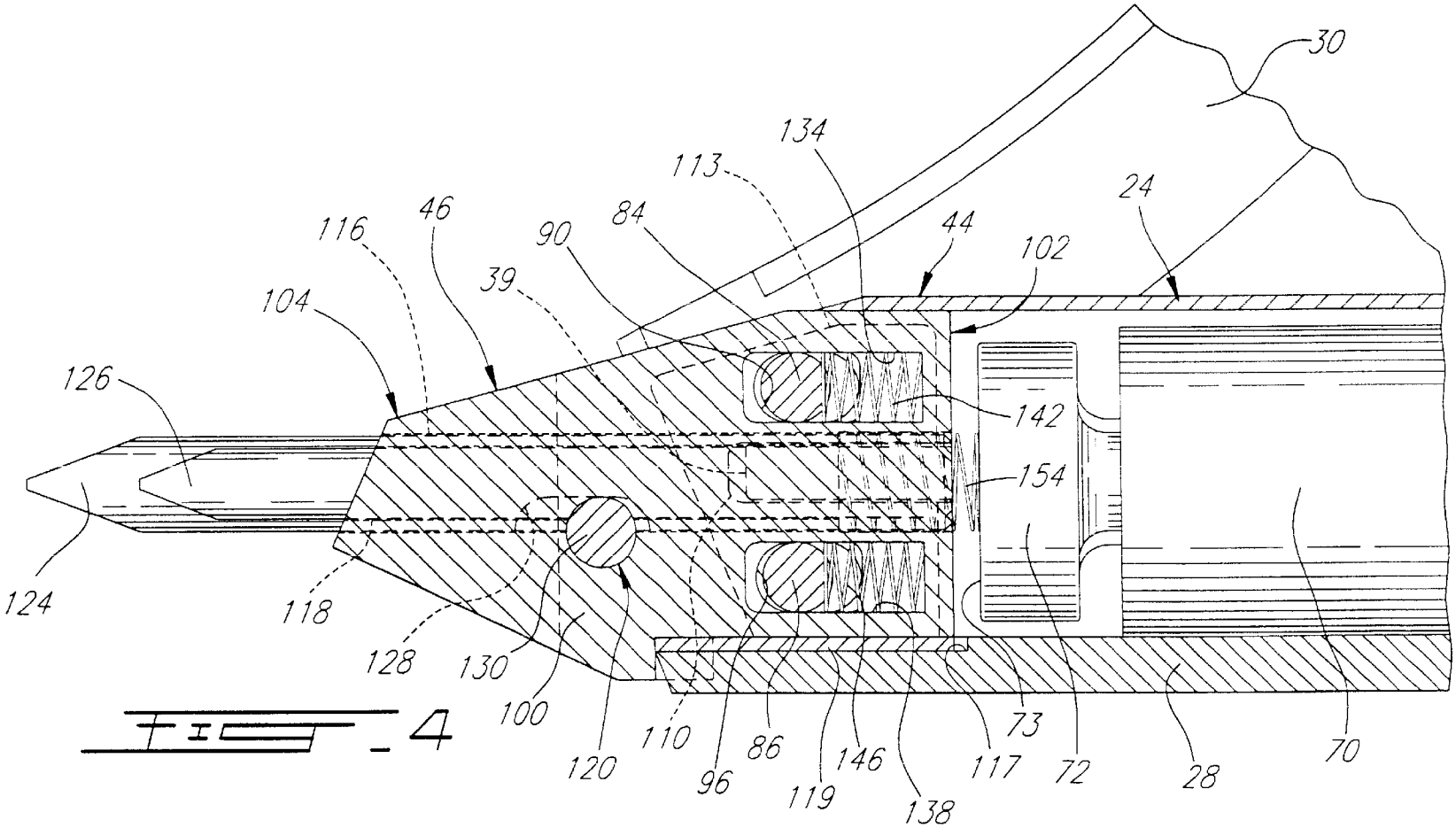
FIG. 4 is a sectional side elevational view taken along line 4—4 of FIG. 2.
Figure 5:
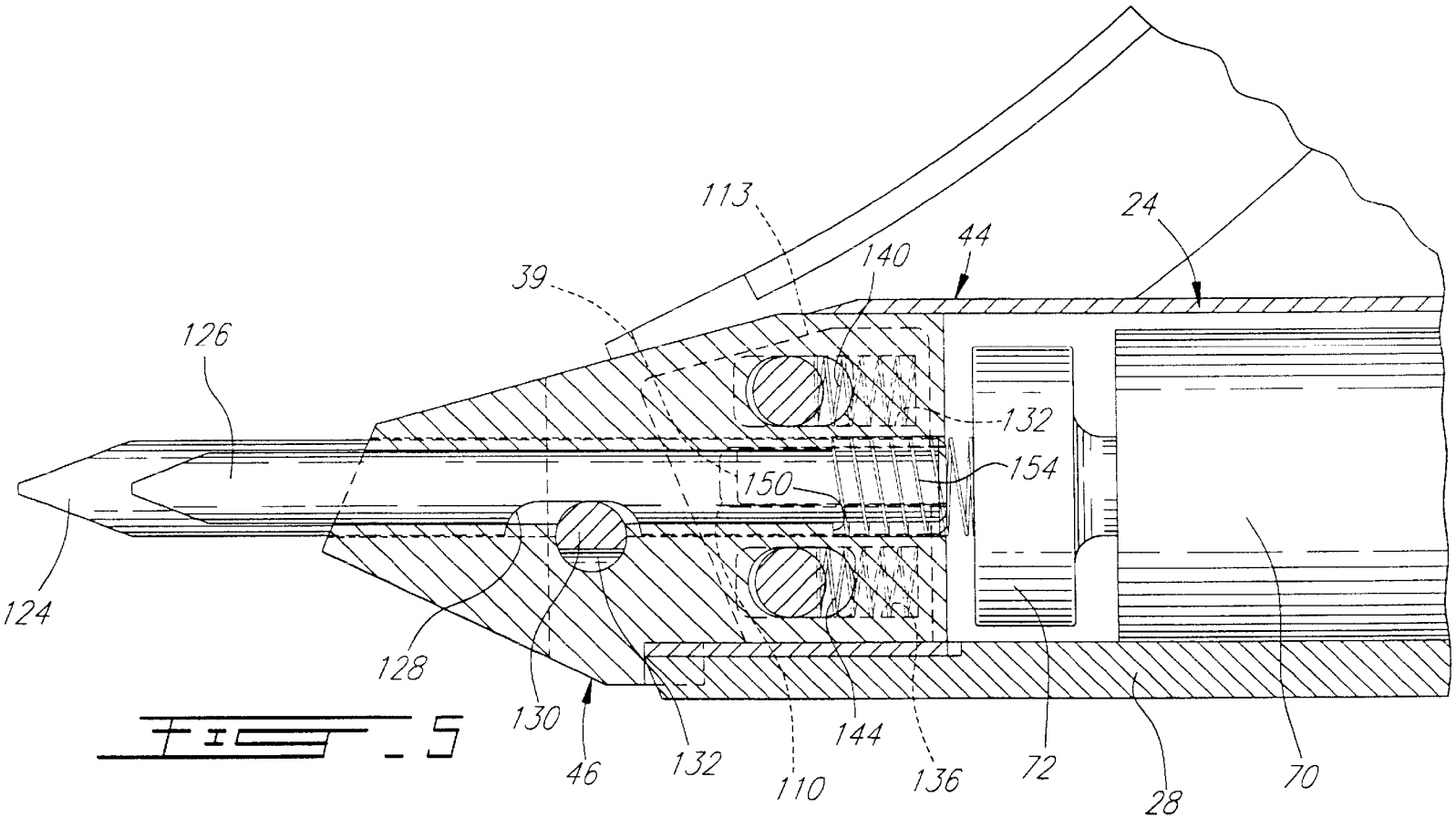
FIG. 5 is a sectional side elevational view taken along line 5—5 of FIG. 2.

Turning now more specifically to FIGS. 3, 4 and 5 of the appended drawings the various elements of the movable head 46 will be described.

The lateral walls 106, 108 are provided with respective channels 110, 112 configured and sized to slidably receive the projections 39 of the guiding elements 35, 37 to thereby slidably mount the movable head 46 to the bucket 22. It is to be noted that the oblong shape of the apertures 90, 96 of the body 100 allow longitudinal sliding movements of the movable head 46 with respect to the bucket 22 while adequately securing the head 46 to the bucket 22. It is also to be noted that the cooperation of the projections 39 with the channels 110, 112 allow longitudinal movements of the movable head 46 while preventing other movements of the movable head.

The lateral walls 106, 108 are also provided with respective friction reducing elements 113, 115, partially embedded in cavities (not shown) of the lateral walls 106, 108, and in contact with the guiding elements 35, 37 to reduce the wear of the surface of both the guiding elements and the body 100. Similarly, the base 28 of the bucket 22 is provided with a shoulder 117 receiving a friction reducing pad 119 onto which the bottom of the body 100 rests. Again, the purpose of the friction reducing pad 119 is to extend the useful life of both the base 28 and the body 100. While the material forming the friction reducing elements 113, 115 and 119 may be modified, it has been found that Nyloil™ type material has been found an adequate friction reducing material for the intended purpose.

The body 100 includes three longitudinal tool receiving apertures 114, 116 and 118 and a tool locking mechanism 120. In FIGS. 1–14, generally cylindrical teeth 122, 124 and 126 are inserted in respective apertures 114, 116 and 118. Each tooth 122–126 is provided with a semi-oblong tangential channel 128 in which a rotatable rod 130 of the locking mechanism 120 is inserted. The rod 130 includes tangential cutouts 132 (FIG. 5) registered with the tool receiving apertures 114, 116 and 118. The rod 130 may be rotated between a locking position (illustrated in the figures) where the rod 130 enters the channels 128 and a non locking position (not shown) where the cutouts 132 face the channels 128 of the teeth 122, 124 and 126 to thereby allow the teeth to be removed from the respective longitudinal tool receiving apertures 114, 116 and 118. As an anti-theft feature, the tool locking mechanism 120 may also includes means (not shown) for preventing unauthorized rotation of the rod 130.

The body 100 also includes four longitudinal spring receiving apertures 132, 134, 136 and 138. The apertures 132 and 134 are open to the oblong aperture 90 while the apertures 136, 138 are open to the oblong aperture 96. The apertures 132–138 are configured and sized to receive respective compression springs 140, 142, 144 and 146 used to bias the movable head 46 towards its retracted position shown in FIGS. 1–5. The compression springs 140–146 are therefore provided between the bottom of their respective aperture 132–138 and one of the cylindrical mounting pin 84, 86. As will be understood by one of ordinary skill in the art, the generally cylindrical mounting pins 84, 86 are advantageously provided with flat portions (not shown) onto which the springs 140–146 may rest.

The longitudinal apertures 114 and 118 of the body 100 are provided with respective spring receiving shoulders 148, 150. A first compression spring 152 (see FIG. 3) is mounted coaxially with the cylindrical tooth 122 between the shoulder 148 and the impact surface 73 of the impact head 72. Similarly, a second compression spring 154 (see FIGS. 4 and 5) is mounted coaxially with the cylindrical tooth 126 between the shoulder 150 and the impact surface 73 of the impact head 72.

As will be easily understood by one of ordinary skill in the art, the purpose of the compression springs 152, 154 is to maintain an adequate longitudinal pressure onto the impact head 72 to ensure that the impact head 72 is not freely movable. The compression springs 152, 154 therefore have a sufficient capacity to apply an adequate pressure onto the impact head 72.

Operation of the excavating bucket 20 will now be described with reference to FIGS. 6–14. As will be apparent to one skilled in the art upon reading of the following description, two modes of operation exist. In a first mode of operation, illustrated in FIGS. 6–10 and referred to as the rock-breaking mode, the excavating bucket 20 is used to break rocks or other hard soil and then to scoop it up in a conventional manner. In a second mode of operation, illustrated in FIGS. 11–14 and referred to as the soil dumping mode, the movable floor 24 is used to disengage soil packed in the bucket body 22.

It is to be noted that FIGS. 6–14 are sectional views taken along the longitudinal axis 23 of the bucket 22 (see FIG. 2).

Turning now to FIGS. 6–10 of the appended drawings, the first mode of operation of the excavating bucket 20 of the present invention will be described. Each of these figures illustrates a general step in the breakage of a rock 200.

FIG. 6 of the appended drawings illustrates the excavating bucket 20 in its initial position before the tooth, 124 contacts the rock 200. Gravity maintains the tooth 124 in a fully extended position where the rod 130 contacts the upper end of the semi-oblong channel 128. The springs 152, 154 (only one shown) are partially compressed by the weight of the impact head 72 and by the downward pressure exerted by the hammer 80 of the impact actuator 70 when it is in its rest state. The impact surface 73 of the impact head 72 therefore rests against the proximate portion 102 of the body 100. The springs 140, 142, 144 and 146 (only two shown) are partially compressed to maintain the movable head 46 in its retracted position by maintaining an adequate pressure between the cylindrical mounting pins 84, 86 and the body 100.

Figure 7:
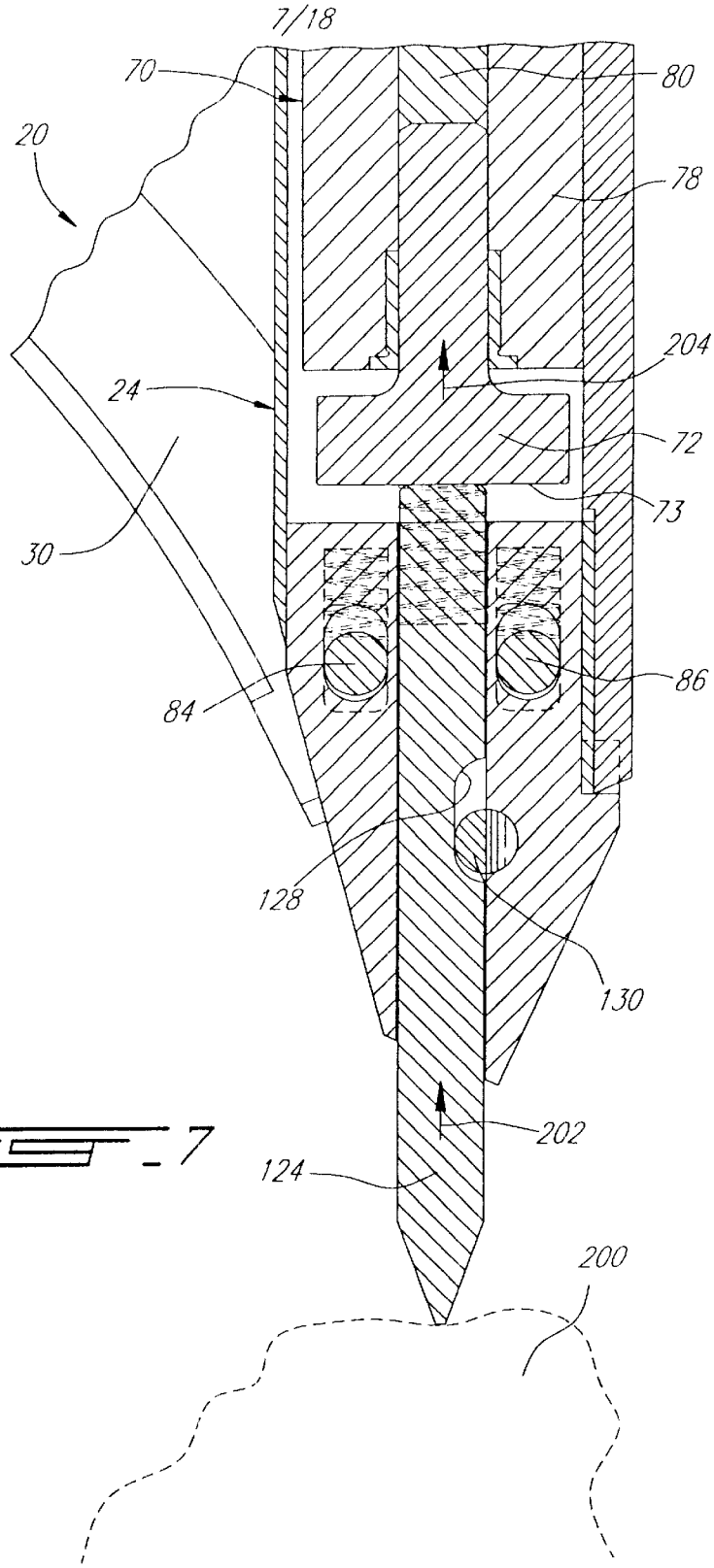
FIG. 7 is a side sectional view illustrating the excavating bucket of FIG. 1 after a contact with a rock and before an impact of the impact actuator.

Turning now to FIG. 7, the contact between the distal end of the tooth 124 and the rock 200 is illustrated. The tooth 124 is pushed in the direction of arrow 202 to reach its fully retracted position illustrated in this figure. In this position, the proximate end of the tooth 124 abuts the impact surface 73 of the impact head 72. This upward movement of the tooth 124 is caused by the movement of the arm (not shown) of the earth moving machine that pushes the excavation bucket 20 downwardly while the rock 200 prevent further forward movements of the tooth 124. This upward movement of the tooth 124 causes the impact head 72 to be pushed upward (see arrow 204) towards its fully retracted position while still contacting the hammer 80.

Figure 8:
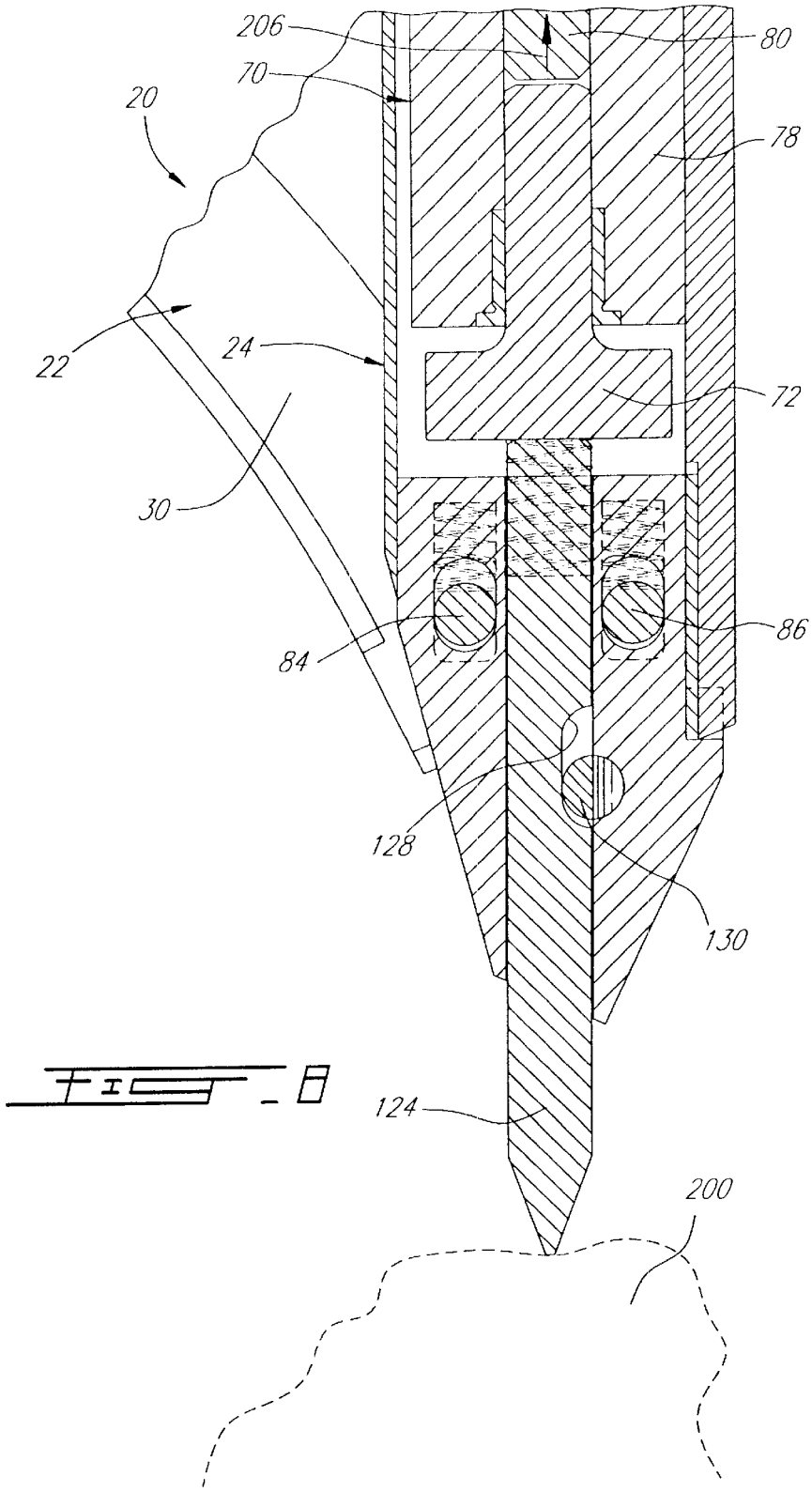
FIG. 8 is a side sectional view illustrating the excavating bucket of FIG. 1, where the internal hammer is preparing an impact.

FIG. 8 of the appended drawings illustrates the impact actuator 70 preparing for an impact. The hammer 80 is moved away from the impact head 72 (see arrow 206) by the energization of the impact actuator 70 by the operator. It is to be noted that since the impact head 72 is in its fully retracted position, it does not follow the hammer 80.

Figure 9:
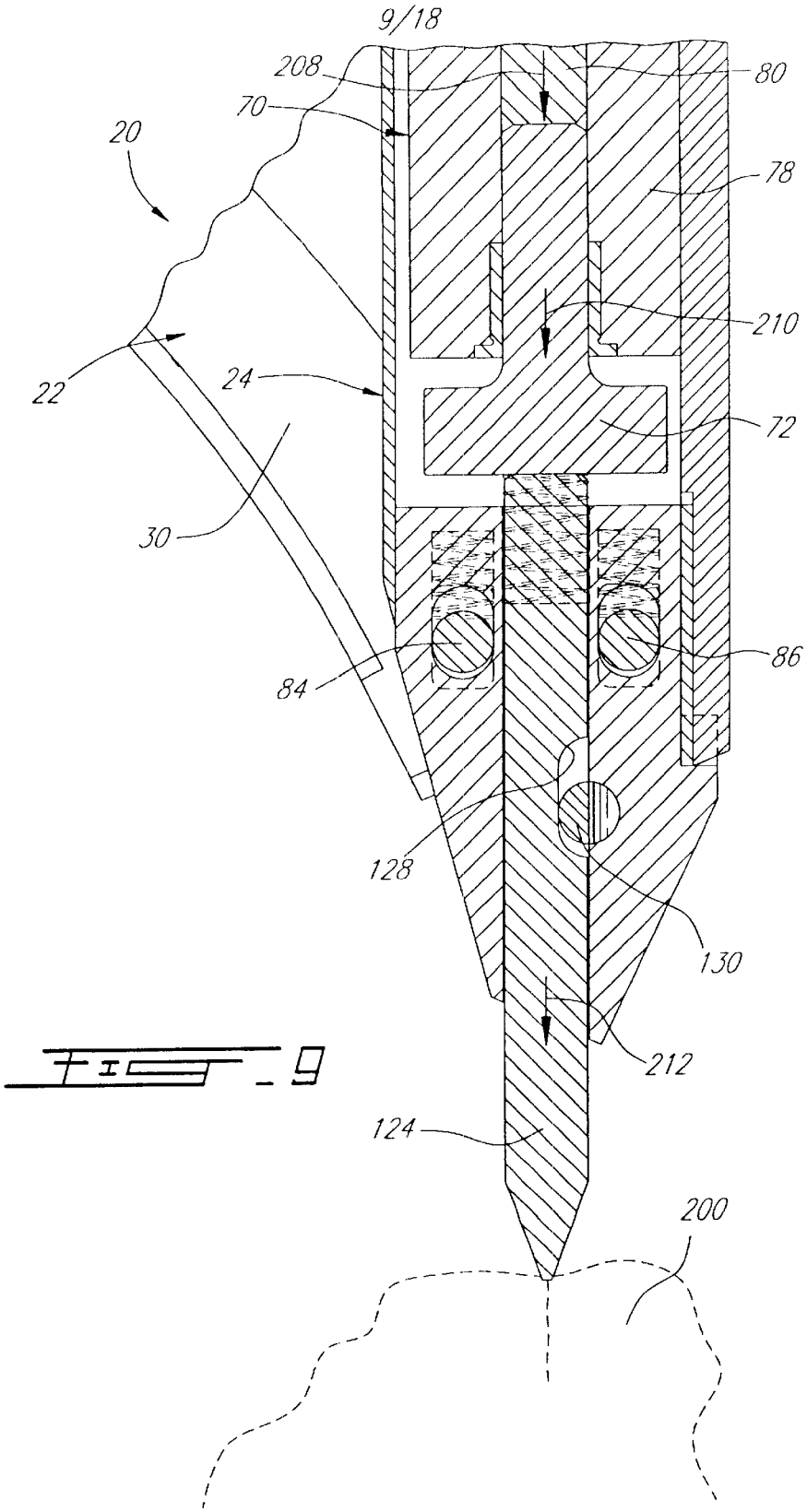
FIG. 9 is a side sectional view illustrating the excavating bucket of FIG. 1 during an impact of the impact actuator.

FIG. 9 illustrates an impact of the impact actuator 70. During this impact, the hammer 80 is forcefully moved downwardly (see arrow 208) in the longitudinal actuator body 78. The hammer 80 therefore forcefully strikes the impact head 72 that, in turn, forcefully pushes (see arrow 210) against the proximate end of the tooth 124. Since the impact actuator 70 is fixedly mounted to the bucket body 22, the impact of the hammer 80 onto the impact head 72 will cause the tooth 124 to forcefully move downward (see arrow 212) in an attempt to break the rock 200.

Figure 10:
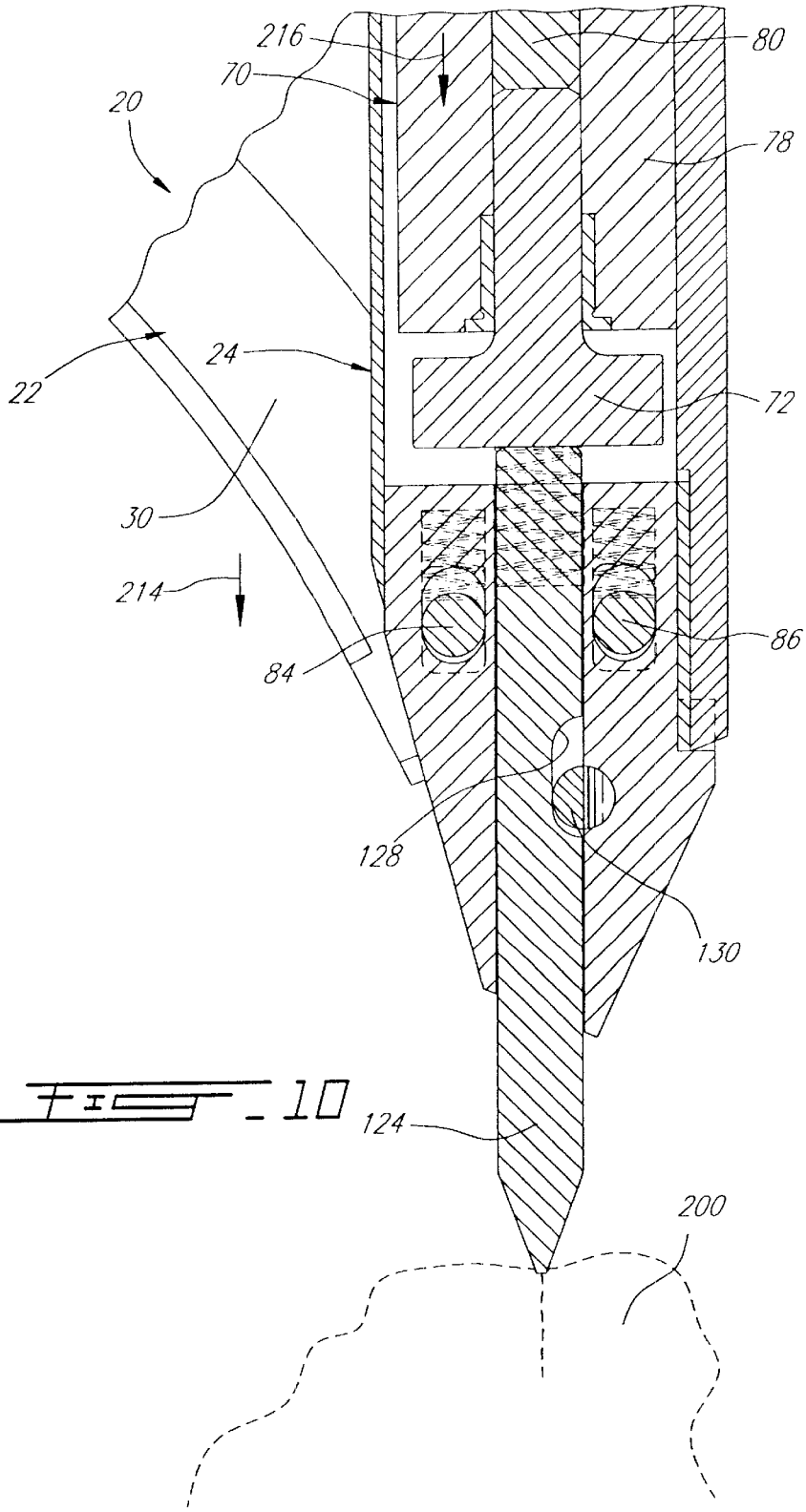
FIG. 10 is a side sectional view illustrating the excavating bucket of FIG. 1 after an impact.

Finally, FIG. 10 of the appended drawings illustrates the downward movement (see arrow 214) of the bucket body 22 caused by the downward motion of the arm (not shown) of the earth moving machine. Since the body 78 of the impact actuator 70 is fixedly mounted to the bucket 22, this downward movement of the bucket 22 will cause the body 78 to move downward (see arrow 216). The tooth 124, the impact head 72 and the hammer 80 will therefore be repositioned in a position similar to the position illustrated in FIG. 7, ready for another impact.

Of course, depending on the hardness of the rock 200, it may take many impacts of the hammer 80 onto the impact head 72 before the rock 200 is fractured as shown in FIG. 10. However, conventional impact actuator assemblies usually have a frequency of impacts of about 15 impacts every second.

It is to be noted that since the distal end of the tooth 124 is in constant contact with the rock 200 the proximate end of the tooth 124 is in constant contact with the impact head 72. The impact surface 73 of the impact head 72 thus always impacts onto the proximate end of the tooth 124 (and possibly teeth 122 and 126 if they contact the rock 200) without impacting onto the body 100, which increases the useful life of the body 100.

It is also to be noted that, as will be easily understood by one skilled in the art, the movements of the hammer 80 into the actuator body 78 are not independently controlled by the operator of the earth moving machine. Indeed, the impact actuator 70, when energized, takes control of the movements of the hammer 80. Therefore, the operator simply has to decide when the impact actuator 70 should be used to more easily scoop or break the intended material.

Turning now to FIG. 11–14 of the appended drawings, the second mode of operation of the excavation bucket 20, i.e. in view of disengaging soil (not shown) that has been packed in the bucket body 22, will be described.

The main difference between the second mode of operation of the excavation bucket 20 and its first mode of operation described hereinabove is that, in the second mode, the teeth 122–126 are not in contact with a hard surface and thus not in contact with the impact head 72. The downward movement of the impact head 72 will therefore cause it to contact forcefully the body 100 of the impact head 46. This impact will move the movable floor 24 forward and therefore assist in the disengagement of packed soil in the bucket 22.

Figure 11:
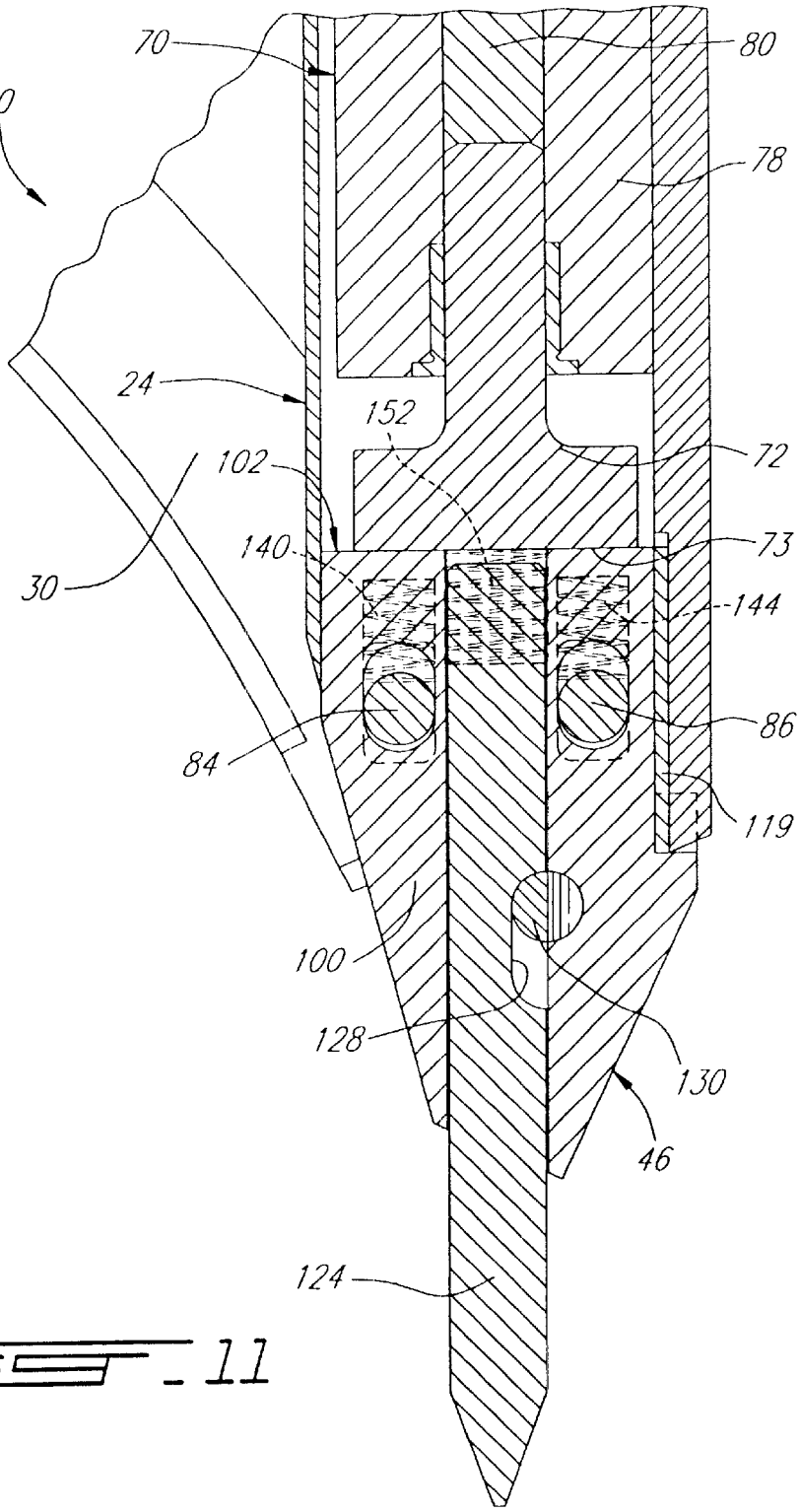
FIG. 11 is a side sectional view illustrating the front portion of the excavating bucket of FIG. 1 before an impact of the impact actuator, where the digging teeth are not in contact with soil.

More specifically, FIG. 11 illustrates the excavation bucket 20 in a non operating state. The tooth 124 is maintained in its fully extended position by gravity. The springs 152, 154 (only one shown) are partially compressed by the weight of the impact head 72 and by the downward pressure exerted by the hammer 80 of the impact actuator 70 when it is in its rest state. The impact surface 73 of the impact head 72 therefore rests against the proximate portion 102 of the body 100. The springs 140, 142, 144 and 146 (only two shown) are partially compressed to maintain the movable head 46 in its retracted position by maintaining an adequate pressure between the cylindrical mounting pins 84, 86 and the body 100.

Figure 12:
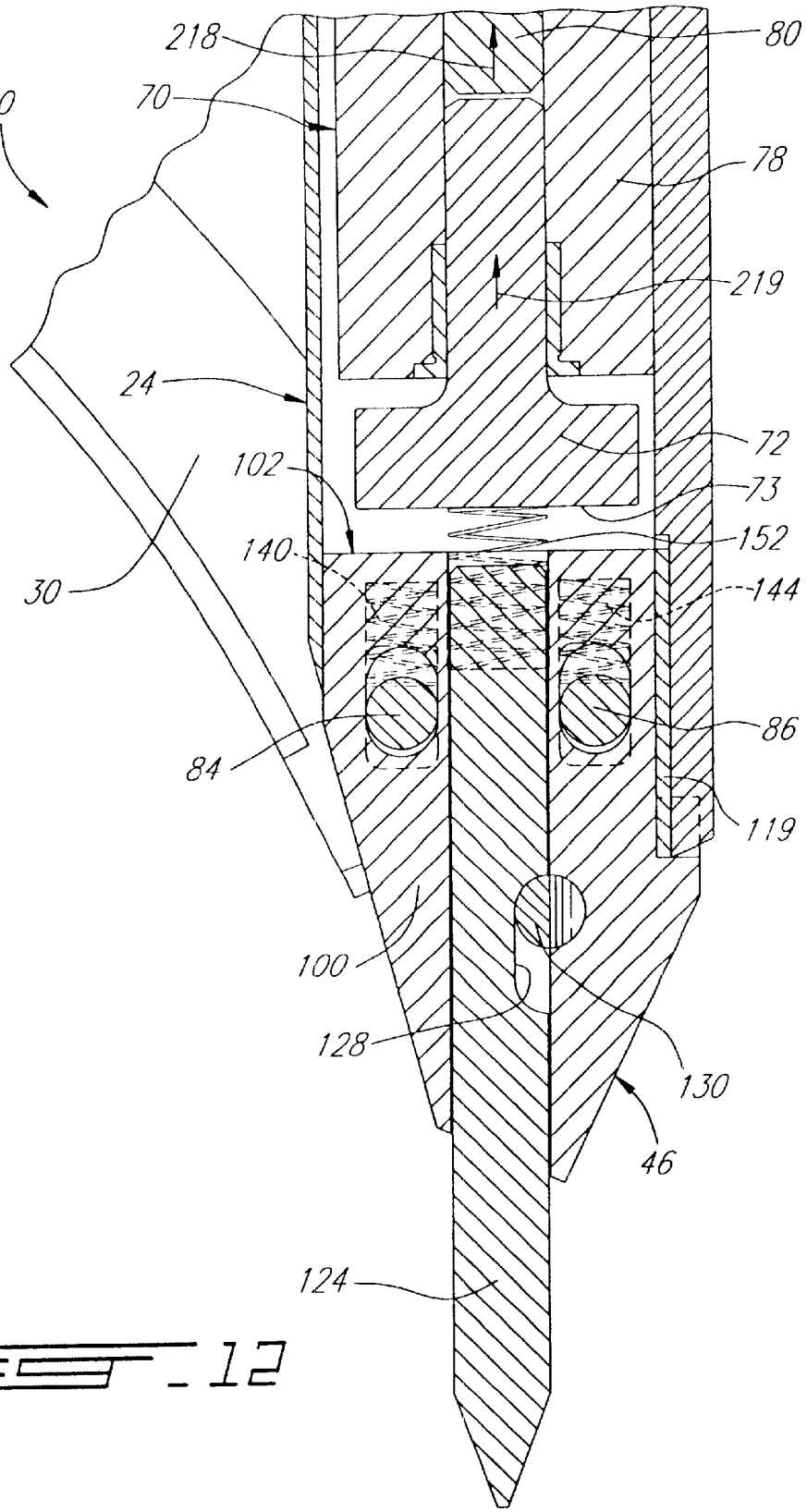
FIG. 12 is a side sectional view illustrating the excavating bucket of FIG. 1, where the internal hammer is preparing an impact.

FIG. 12 illustrates the impact actuator 70 preparing an impact. The hammer 80 is moved upwardly (see arrow 218) by the energization of the impact actuator 70 by the operator. It is to be noted that the impact head 72 is moved (see arrow 219) from its extended position of FIG. 11 to its fully retracted position of FIG. 12 by the springs 152, 154. Indeed, the energization of the impact actuator 70 removes the pressure from the hammer 80 onto the impact head 72 and therefore allows the springs 152, 154 to move the impact head 72 upwardly.

Figure 13:
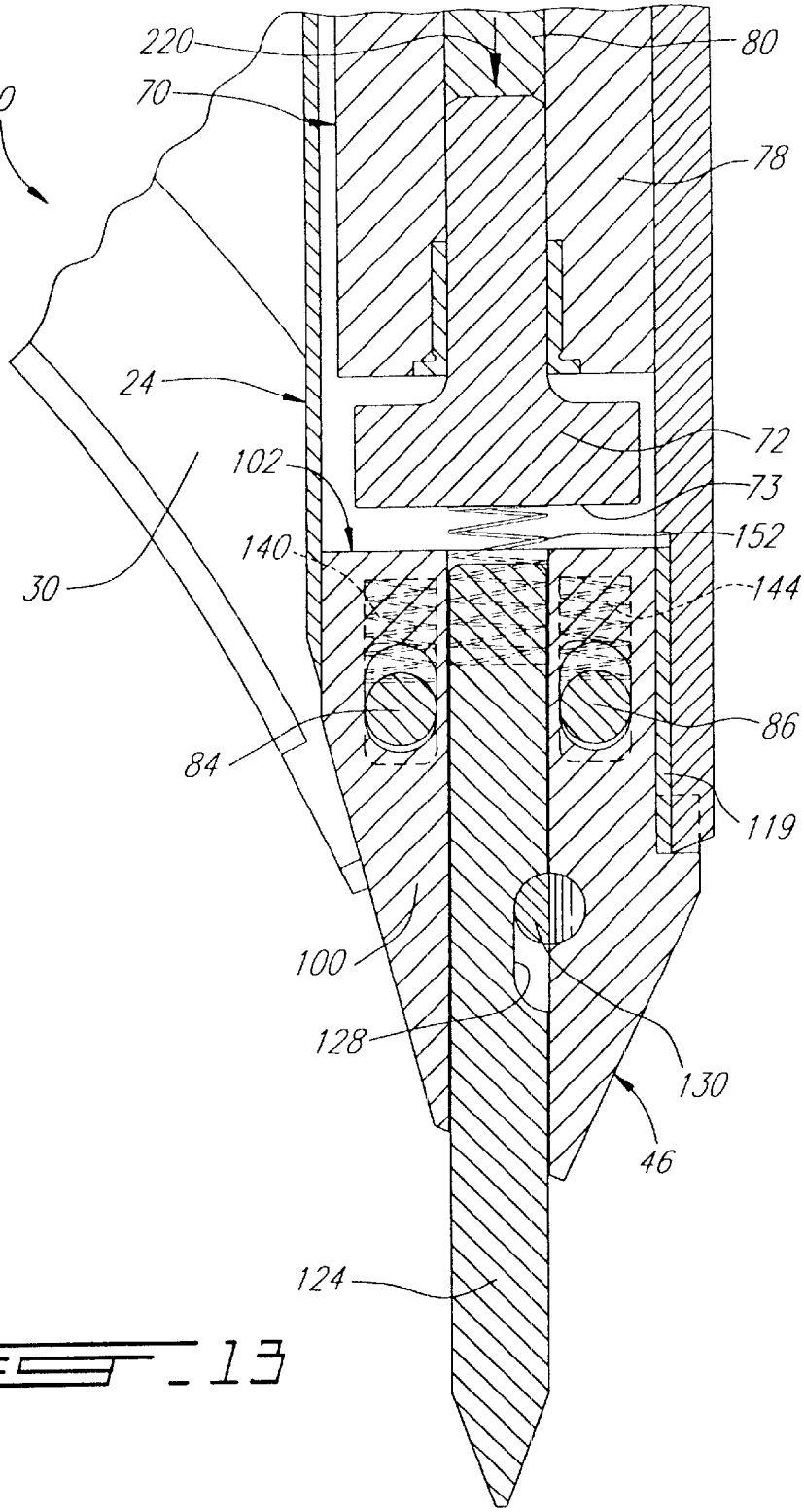
FIG. 13 is a side sectional view illustrating the excavating bucket of FIG. 1 during an impact of the internal hammer of the impact actuator.

FIG. 13 illustrates the impact between the hammer 80 and the impact head 72. The hammer 80 is forcefully moved downwardly (see arrow 220) and impacts the impact head 72.

Figure 14:
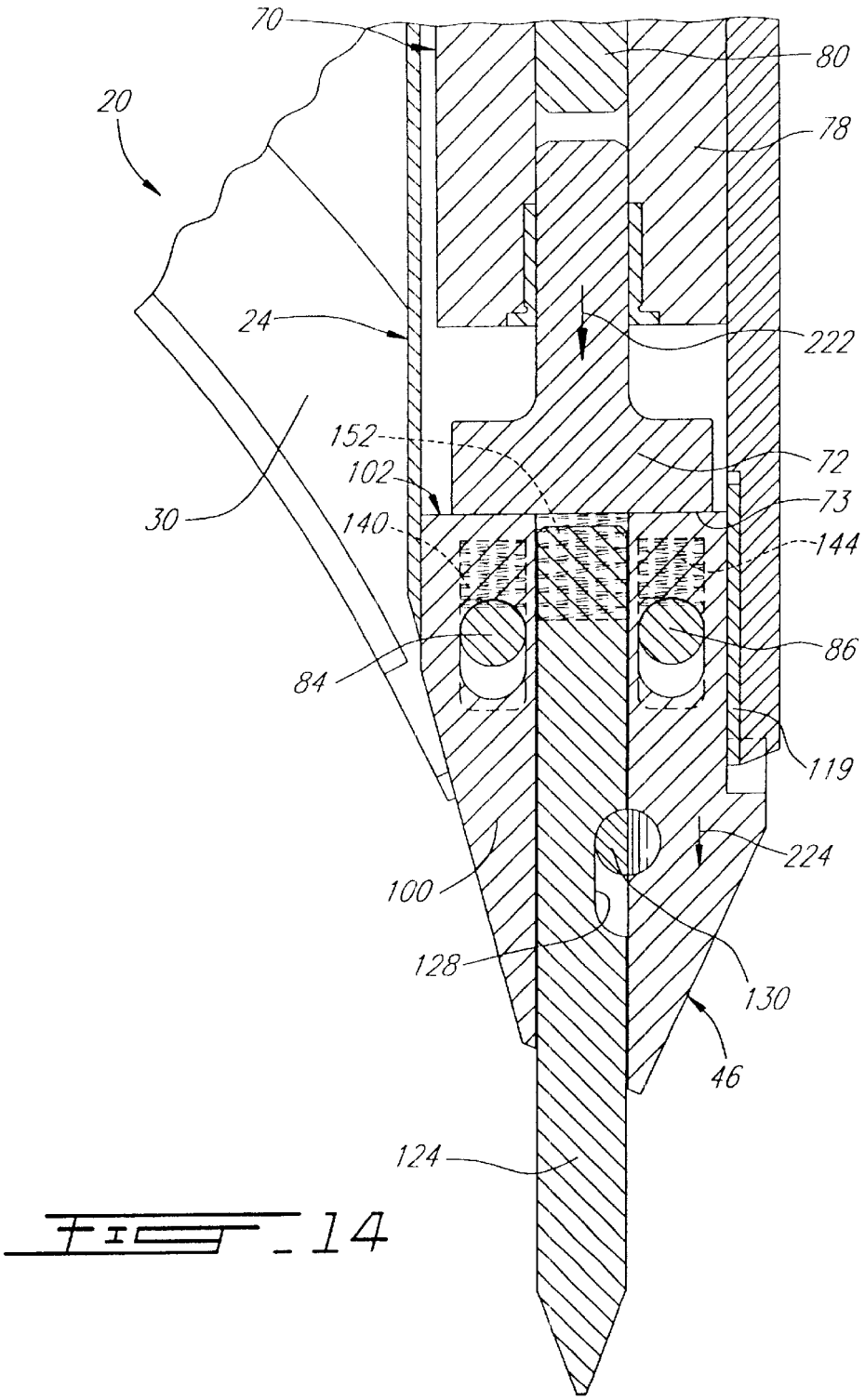
FIG. 14 is a side sectional view illustrating the excavating bucket of FIG. 1 after an impact of the internal hammer of the impact actuator.

The downward movement (see arrow 222) of the impact head 72 is illustrated in FIG. 14. The impact surface 73 of the impact head 72 compresses the springs 152, 154 to contact the proximate portion 102 of the body 100 to forcefully slide it downwardly (see arrow 224). Of course, since the movable floor 24 is fixedly mounted to the body 100, it will also be downwardly slid. The movement of the body 100 also compresses the springs 140, 142,144 and 146.

Turning briefly to FIG. 1 of the appended drawings, it is to be noted that the rear curved portion 66 of the movable floor 24 pushes the soil (not shown) packed in the bucket 22 when the movable floor 24 is slid as described hereinabove. This curved portion 66 also prevents large pieces of soil to enter the free space 68 between the movable floor 24 and the base 28.

Returning to FIG. 14, once the energy of the impact head 72 is transferred to the body 100, the compressed springs 140–146 will move the body 100, and thus the movable floor 24, from its extended position illustrated in FIG. 14 to its retracted position illustrated in FIG. 11 while the compressed springs 152, 154 will move the impact head 72 from its extended position illustrated in FIG. 14 to its retracted position illustrated in FIG. 11 in preparation for further impacts.

As described hereinabove, since conventional impact actuators have a frequency of operation of about 15 cycles per second, the movable floor 24 will be slid back and forth about 15 times per second, thus facilitating the disengagement of soil packed in the bucket body 22.

As will be easily understood by one skilled in the art, the excavation bucket 20 of the present invention has many advantages over the prior art, for example:

- the constant pressure applied by the springs 152, 154 onto the impact head 72 allow the impact actuator 70 to be used to disengage soil packed in the bucket body 22;
- the fact that the impact head 72 does not contact the body 100 during hard soil breaking operations increases the useful life of the movable head 46;
- the use of cylindrical mounting pins 84, 86 to mount the movable head 46 to the bucket 22 allows the moveable head 46 to be easily removed;
- the mechanical elements are mainly provided in the body 100 of the movable head 46; and
- the body 100 is advantageously made of a single piece of an adequate metallic material.

Figure 15:
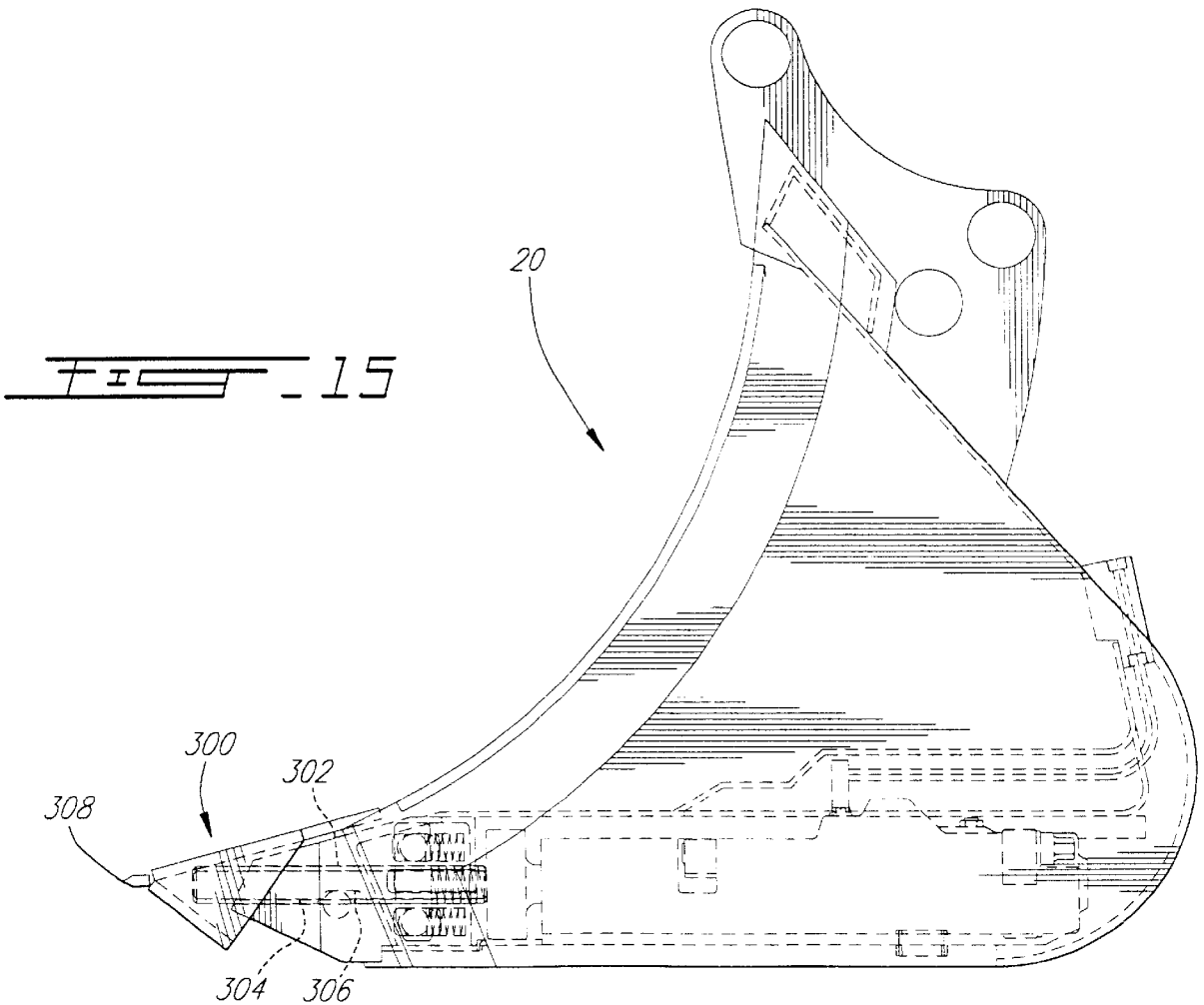
FIG. 15 is a side elevational view of the excavating bucket of FIG. 1 provided with a clay cutting attachment.

FIG. 15 of the appended drawings illustrates the excavation bucket 20 to which a clay cutting attachment 300 has been fitted. The clay cutting attachment 300 includes a central mounting rods 302 and two lateral mounting rods 304 (only one shown) configured, sized and positioned to enter the three tool receiving apertures 114, 116 and 118 of the body 100. Each mounting rod is provided with a tangential channel 306 enabling the rods to be locked in position by the tool locking mechanism 120 as described hereinabove with respect to the teeth 122, 124 and 126. The edge 308 of the clay cutting attachment 300 is sufficiently sharp to easily cut through clay.

Figure 16:
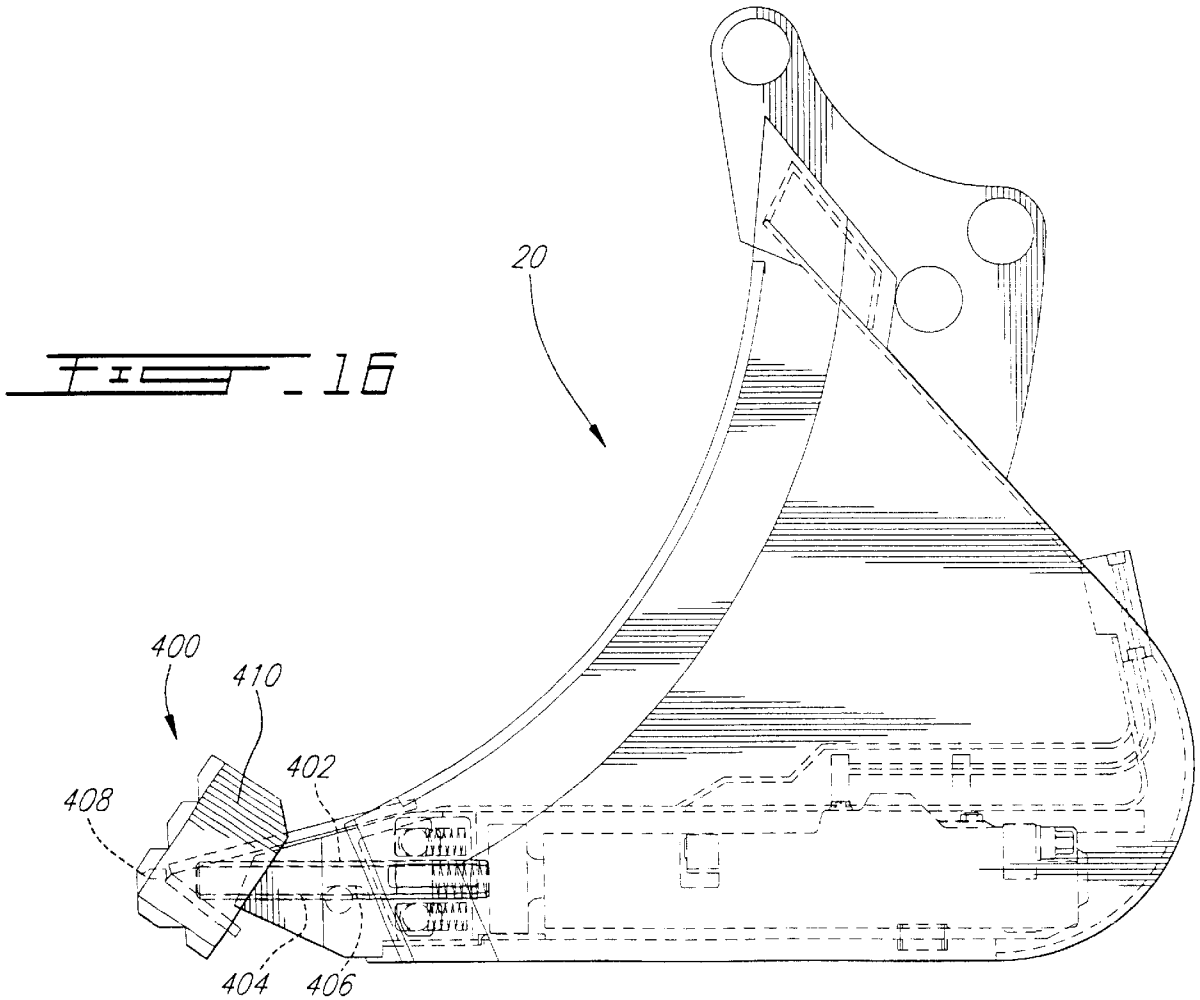
FIG. 16 is a side elevational view of the excavating bucket of FIG. 1 provided with a root shredding attachment.

Turning now to FIG. 16, a root shredding attachment 400 will be described. The root shredding attachment 400 includes a central mounting rods 402 and two lateral mounting rods 404 (only one shown) configured, sized and positioned to enter the three tool receiving apertures 114, 116 and 118 of the body 100. Again, each mounting rod is provided with a tangential channel 406 enabling the rods to be locked in position by the tool locking mechanism 120. The root shredding attachment 400 includes a serrated central blade 408 and a pair of lateral serrated blades 410 (only one shown).

Figure 17:
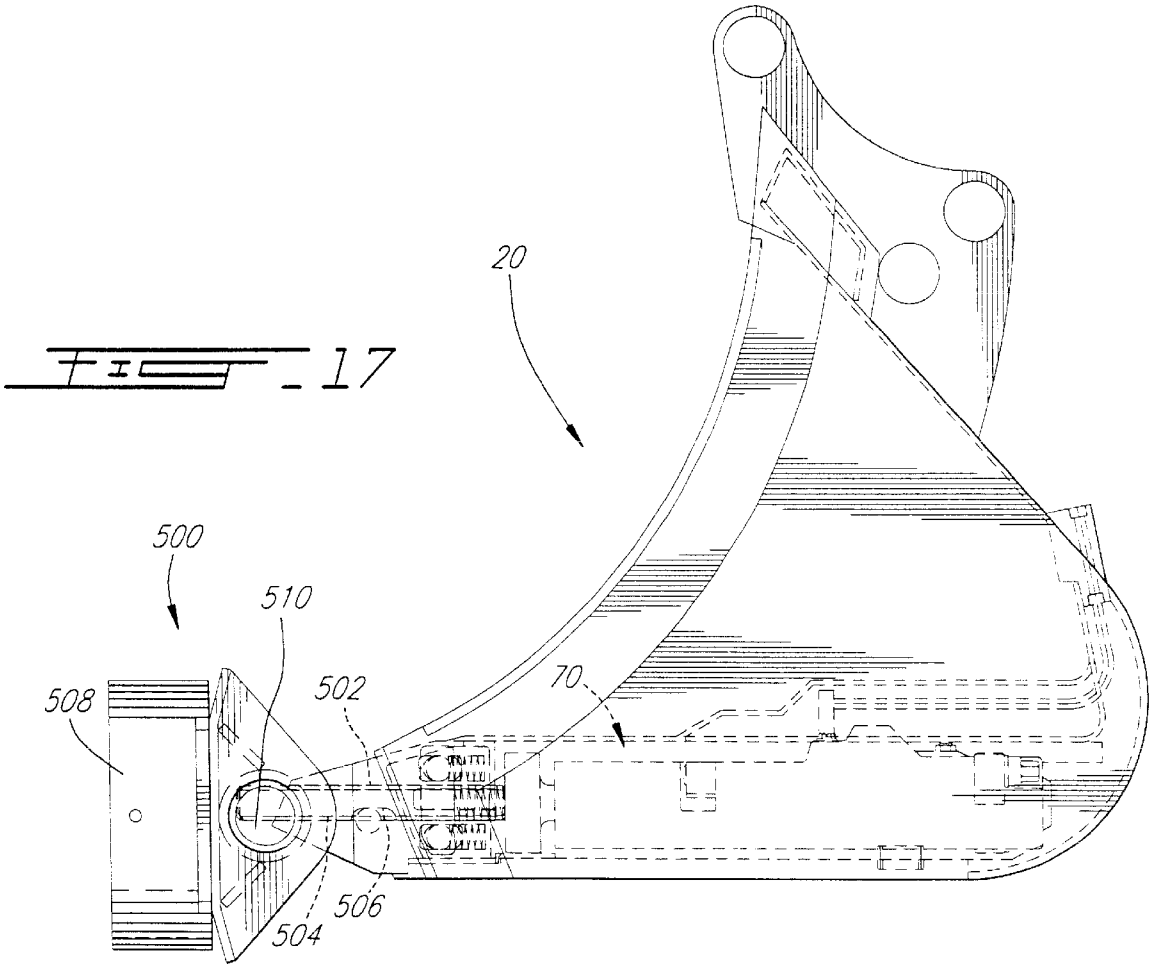
FIG. 17 is a side elevational view of the excavating bucket of FIG. 1 provided with a picket ramming attachment.

FIG. 17 illustrates a picket ramming attachment 500 including a central mounting rods 502 and two lateral mounting rods 504 (only one shown) configured, sized and positioned to enter the three tool receiving apertures 114, 116 and 118 of the body 100. Again, each mounting rod is provided with a tangential channel 506 enabling the rods to be locked in position by the tool locking mechanism 120. The picket ramming attachment 500 includes a cylindrical picket holder 508 that may be pivoted about a pivot attachment 510. A picket to be rammed (not shown) is inserted in the picket holder 508 and the impact actuator 70 is energized to help ramming the picket in the ground.

Figure 18:
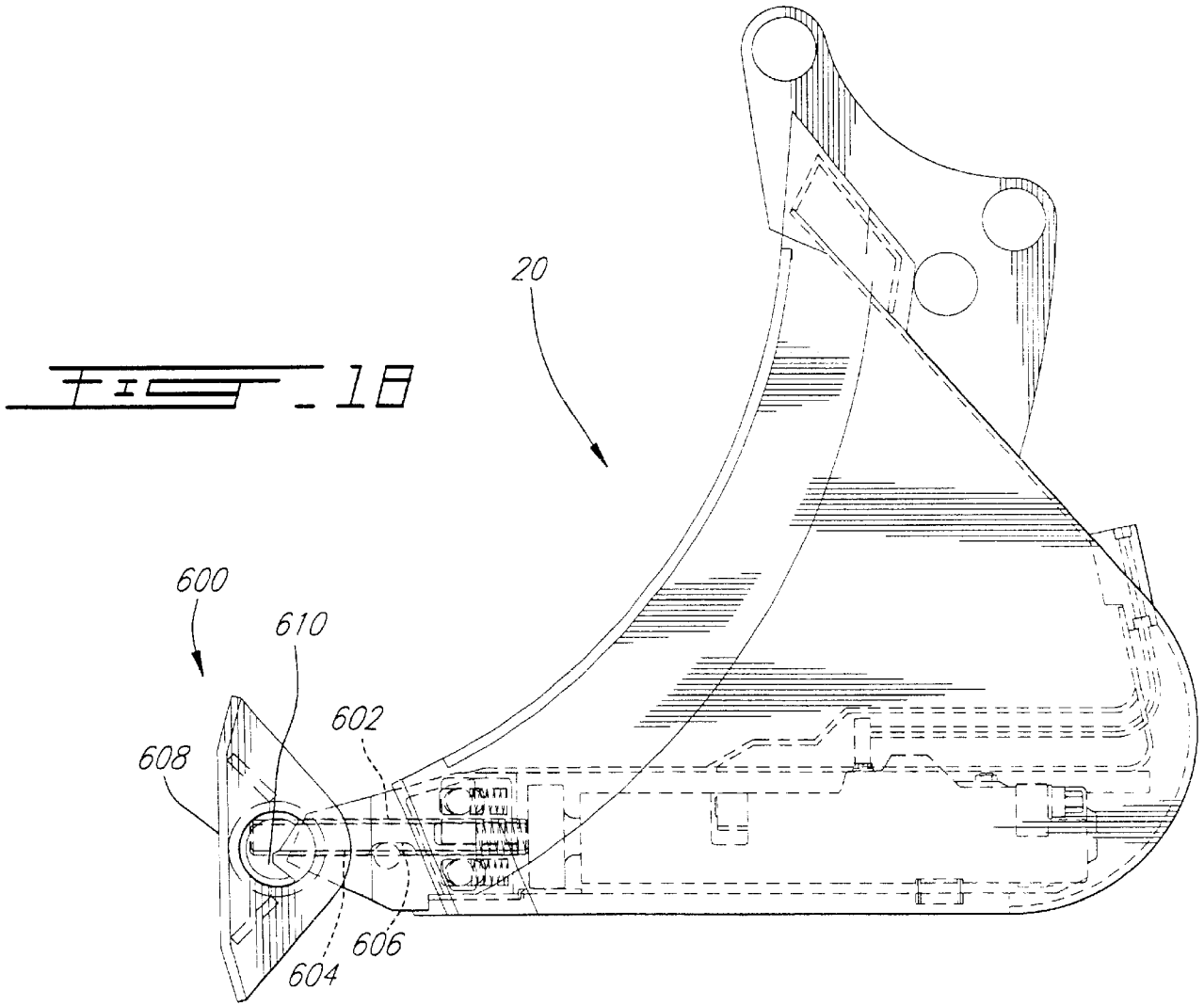
FIG. 18 is a side elevational view of the excavating bucket of FIG. 1 provided with a compaction attachment.

Finally, FIG. 18 illustrates a compaction attachment 600 including a central mounting rods 602 and two lateral mounting rods 604 (only one shown) configured, sized and positioned to enter the three tool receiving apertures 114, 116 and 118 of the body 100. Again, each mounting rod is provided with a tangential channel 606 enabling the rods to be locked in position by the tool locking mechanism 120. The compaction attachment 600 includes a flat compaction head 608 that may be pivoted about a pivot attachment 610.

It is to be noted that the energization of the impact actuator 70 could be done automatically when the tooth 124 contacts a hard surface. For example, a pressure sensor (not shown) could be associated with the tooth 124 to detect the contact between the tooth 124 and the impact head 72. The output of this sensor would be used to selectively energize the impact actuator 70 when the pressure detected is above a predetermined level. Another way of achieving the same result would be to provide a displacement sensor (not shown) detecting the displacement of the tooth 124 with respect to the bucket body 22. Again, the output of this sensor would be used to selectively energize the impact actuator 70 when the displacement detected is above a predetermined level.

Although the present invention has been described hereinabove by way of preferred embodiments thereof, it can be modified, without departing from the spirit and nature of the subject invention as defined in the appended claims.

What is claimed is:

1. An excavation bucket comprising:

a bucket body including a floor portion and lateral side portions; said floor portion having a longitudinal axis;

a movable floor so mounted to said bucket body as to (a) be longitudinally slidable between a retracted position and an extended position, and (b) provide a free space between said floor portion and said movable floor; and sliding means for selectively sliding said movable floor between said retracted and extended positions; said sliding means being mounted in said free space, said sliding means including an impact actuator.

2. An excavation bucket as recited in claim 1, wherein said sliding means are fixedly mounted to said bucket body and associated with said movable floor.

3. An excavation bucket as recited in claim 1 wherein said impact actuator includes an actuator body mounted to said bucket body and an impact head so mounted to said actuator body as to be selectively movable between a retracted position and an extended position.

4. An excavation bucket as recited in claim 3, further comprising a movable head so mounted to said bucket body as to be longitudinally slidable between a retracted position and an extended position; said movable floor being fixedly mounted to said movable head; said movable head including a movable head body and first biasing means biasing said movable head body towards said retracted position.

5. An excavation bucket as recited in claim 4, wherein said first biasing means include at least one compression spring.

6. An excavation bucket as recited in claim 4, further comprising second biasing means mounted between said movable head body and said impact head to bias said impact head towards its retracted position.

7. An excavation bucket as recited in claim 6, wherein said second biasing means include at least one compression spring.

8. An excavation bucket as recited in claim 6, wherein said movable head body includes at least one longitudinal tool receiving aperture.

9. An excavation bucket as recited in claim 8, further comprising a clay cutting attachment releasably inserted in said at least one tool receiving aperture.

10. An excavation bucket as recited in claim 8, further comprising a root shredding attachment releasably inserted in said at least one tool receiving aperture.

11. An excavation bucket as recited in claim 8, further comprising a picket ramming attachment releasably inserted in said at least one tool receiving aperture.

12. An excavation bucket as recited in claim 8, further comprising a compaction attachment releasably inserted in said at least one tool receiving aperture.

13. An excavation bucket as recited in claim 8, wherein said movable head body has a proximate end and a distal end; said at least one longitudinal tool receiving aperture extending from said proximate end to said distal end; said movable head further including at least one tool configured and sized to be slidably inserted in said at least one tool receiving aperture; said at least one tool being slidable between an extended position and a retracted position where said at least one tool contacts said impact head; wherein (a) reciprocate movements of said impact head of said impact actuator slide said movable floor when said at least one tool is in its extended position and (b) reciprocate movements of said impact head of said impact actuator slide said at least one tool when said at least one tool is in its retracted position.

14. An excavation bucket as recited in claim 13, wherein said movable head body also includes a tool locking mechanism to selectively lock said at least one tool in said at least one tool receiving aperture while allowing the sliding movements of said at least one tool between said extended and retracted positions.

15. An excavation bucket as recited in claim 14, wherein said tool locking mechanism includes a cylindrical rod so mounted to a transversal aperture of said movable head body as to be rotatable between a locking position and an unlocking position; said cylindrical rod including at least one longitudinal channel facing a tangential channel of said at least one tool when said pivot bar in said non locking position.

16. An excavation bucket as recited in claim 13, wherein said tool holding assembly includes three tool receiving longitudinal apertures.

17. An excavation bucket as recited in claim 16, further comprising three teeth releasably mounted to a respective tool receiving aperture.

18. An excavation bucket as recited in claim 4, wherein said movable head includes means for preventing its extended position to be exceeded.

19. An excavation bucket as recited in claim 18, wherein said preventing means including means for mounting said movable head body to said bucket body while allowing said movable head body to slide between said retracted and extended positions.

20. An excavation bucket as recited in claim 19, wherein said mounting means include a mounting rod, transversal oblong apertures of the movable head body and circular apertures of the lateral side portions; said mounting rod being configured and sized to be inserted in the oblong and circular apertures to therefore mount the movable head body to the side portions of the bucket body while allowing longitudinal movements of the movable head body.

21. An excavation bucket as recited in claim 1, wherein said lateral side portions of said bucket body include internal lateral guides allowing longitudinal movements of said movable floor and preventing other movements of said movable floor.

22. An excavation bucket comprising:

a bucket body including a floor portion and lateral side portions; said floor portion having a longitudinal axis;

a movable head so mounted to said bucket body as to be longitudinally slidable between a retracted position and an extended position; said movable head including a movable head body provided with a proximate end and a distal end and at least one tool receiving aperture extending from said proximate end to said distal end;

a movable floor so mounted to said movable head body as to provide a free space between said floor portion and said movable floor;

an impact actuator including an impact actuator body mounted to said bucket body and impact head so mounted to said actuator body as to be selectively movable between a retracted position and an extended position; said impact actuator being mounted in said free space; and at least one tool configured and sized to be slidably inserted in said at least one tool receiving aperture of said movable head body; when inserted in said at least one tool receiving aperture, said at least one tool being slidable between an extended position and a retracted position where said at least one tool contacts said impact head; wherein said impact head, when in its extended position, (a) contacts said proximate end of said movable head body when said at least one tool is in its extended position and (b) contacts said at least one tool when said at least one tool is in its retracted position.

23. An excavation bucket as recited in claim 22, further comprising biasing means biasing said movable head body towards said retracted position.

24. An excavation bucket as recited in claim 23, wherein said biasing means include at least one compression spring.

25. An excavation bucket as recited in claim 22, further comprising biasing means mounted between said movable head body and said impact head to bias said impact head towards its retracted position.

26. An excavation bucket as recited in claim 25, wherein said biasing means include at least one compression spring.

27. An excavation bucket as recited in claim 22, wherein said movable head body also includes a tool locking mechanism to selectively lock said at least one tool in said at least one tool receiving aperture while allowing the sliding movements of said at least one tool between its extended and retracted positions.

28. An excavation bucket as recited in claim 27, wherein said tool locking mechanism includes a cylindrical rod so mounted to a transversal aperture of said movable head body as to be rotatable between a locking position and an unlocking position; said cylindrical rod including at least one longitudinal channel facing a tangential channel of said at least one tool when said pivot bar in said non locking position.

29. An excavation bucket as recited in claim 22, wherein said movable head includes means for preventing its extended position to be exceeded.

30. An excavation bucket as recited in claim 29, wherein said preventing means including means for mounting said movable head body to said bucket body while allowing said movable head body to slide between said retracted and extended positions.

31. An excavation bucket as recited in claim 30, wherein said mounting means include a mounting rod, transversal oblong apertures of the movable head body and circular apertures of the lateral side portions; said mounting rod being configured and sized to be inserted in the oblong and circular apertures to therefore mount the movable head body to the side portions of the bucket body while allowing longitudinal movements of the movable head body.

32. An excavation bucket as recited in claim 22, wherein said tool holding assembly includes three tool receiving longitudinal apertures.

33. An excavation bucket as recited in claim 32, wherein said at least one tool include three teeth releasably mounted to a respective tool receiving aperture.

34. An excavation bucket as recited in claim 22, wherein said at least one tool includes a clay cutting attachment releasably inserted in said at least one tool receiving aperture.

35. An excavation bucket as recited in claim 22, wherein said at least one tool includes a root shredding attachment releasably inserted in said at least one tool receiving aperture.

36. An excavation bucket as recited in claim 22, wherein said at least one tool includes a picket ramming attachment releasably inserted in said at least one tool receiving aperture.

37. An excavation bucket as recited in claim 22, wherein said at least one tool includes a compaction attachment releasably inserted in said at least one tool receiving aperture.

38. An excavation bucket as recited in claim 22, wherein said lateral side portions of said bucket body includes internal lateral guides allowing longitudinal movements of said movable floor and preventing other movements of said movable floor.

* * * * *